US007841765B2

(12) United States Patent
Keller

(10) Patent No.: US 7,841,765 B2
(45) Date of Patent: Nov. 30, 2010

(54) STATIC MIXER

(75) Inventor: Wilhelm A. Keller, Rotkreuz (CH)

(73) Assignee: Sulzer Mixpac AG, Rotkreuz (CH)

( * ) Notice: Subject to any disclaimer, the term of this patent is extended or adjusted under 35 U.S.C. 154(b) by 43 days.

(21) Appl. No.: 11/979,261

(22) Filed: Oct. 31, 2007

(65) Prior Publication Data

US 2008/0232191 A1 Sep. 25, 2008

Related U.S. Application Data

(63) Continuation of application No. 11/409,102, filed on Apr. 24, 2006, now Pat. No. 7,325,970, which is a continuation of application No. 10/727,049, filed on Dec. 4, 2003, now abandoned.

(30) Foreign Application Priority Data

Dec. 6, 2002 (CH) ..... 2072/02

(51) Int. Cl.
*B01F 5/06* (2006.01)

(52) U.S. Cl. ..... 366/339; 366/338

(58) Field of Classification Search ..... 366/181.5, 366/336–340; 48/189.4; 138/37, 39, 40, 138/42; 222/145.6
See application file for complete search history.

(56) References Cited

U.S. PATENT DOCUMENTS

| | | | | |
|---|---|---|---|---|
| 3,051,453 | A * | 8/1962 | Sluijters | 366/337 |
| 3,195,865 | A * | 7/1965 | Harder | 366/337 |
| 3,239,197 | A * | 3/1966 | Tollar | 366/337 |
| 3,328,003 | A * | 6/1967 | Chisholm | 366/337 |
| 3,406,947 | A * | 10/1968 | Harder | 366/337 |
| 4,040,256 | A * | 8/1977 | Bosche et al. | 405/119 |
| 4,179,222 | A * | 12/1979 | Strom et al. | 366/337 |
| 5,851,067 | A * | 12/1998 | Fleischli et al. | 366/337 |
| 5,944,419 | A * | 8/1999 | Streiff | 366/337 |
| 6,599,008 | B2 * | 7/2003 | Heusser et al. | 366/337 |
| 6,773,156 | B2 * | 8/2004 | Henning | 366/337 |
| 7,322,740 | B2 * | 1/2008 | Heusser et al. | 366/337 |
| 7,325,970 | B2 * | 2/2008 | Keller | 366/337 |
| 7,438,464 | B2 * | 10/2008 | Moser et al. | 366/336 |
| 2001/0015936 | A1 * | 8/2001 | Heusser et al. | 366/337 |

(Continued)

FOREIGN PATENT DOCUMENTS

| | | |
|---|---|---|
| DE | 2352480 | 12/1998 |

(Continued)

*Primary Examiner*—Charles E Cooley
(74) *Attorney, Agent, or Firm*—Foley & Lardner, LLP

(57) ABSTRACT

The static mixer comprises mixing elements for separating material to be mixed into a plurality of streams and a mechanism for the layered junction of the same, a transversal edge and guide walls that extend at an angle to said transversal edge, as well as deflecting elements arranged at an angle to the longitudinal axis and provided with openings. The mixer includes mixing elements comprising a transversal edge and a following transversal guide wall and at least two guide walls with lateral end sections and at least one bottom section disposed between said guide walls, thereby defining at least one opening on one side of said transversal edge and at least two openings on the other side of said transversal edge. In addition to a high mixing efficiency and a low pressure drop, a mixer of this kind provides reduced dead volumes and is thus more effective than mixers of the prior art.

15 Claims, 9 Drawing Sheets

U.S. PATENT DOCUMENTS

| | | | | |
|---|---|---|---|---|
| 2003/0048694 | A1* | 3/2003 | Horner et al. | 366/337 |
| 2003/0179648 | A1* | 9/2003 | Heusser et al. | 366/336 |
| 2004/0008576 | A1* | 1/2004 | Henning | 366/337 |
| 2004/0141413 | A1* | 7/2004 | Keller | 366/337 |
| 2008/0232191 | A1* | 9/2008 | Keller | 366/339 |
| 2009/0310437 | A1* | 12/2009 | Pappalardo | 366/337 |

FOREIGN PATENT DOCUMENTS

| | | | |
|---|---|---|---|
| DE | 29922044 | U1 * | 5/2000 |
| EP | 0163217 | | 12/1985 |
| JP | 62-269733 | | 11/1987 |
| WO | WO-99/00180 | | 1/1999 |

* cited by examiner

STATIC MIXER

CROSS-REFERENCE TO RELATED PATENT APPLICATIONS

This application is a continuation of U.S. patent application Ser. No. 11/409,102 filed Apr. 24, 2006, now issued as U.S. Pat. No. 7,325,970, which is a continuation of U.S. patent application Ser. No. 10/727,049 filed Dec. 4, 2003, now abandoned, and based on Swiss Patent Application No. 2002 2072/02 filed Dec. 6, 2002, all of which are incorporated herein by reference in their entirety. This application claims only subject matter disclosed in the parent application and therefore presents no new matter.

BACKGROUND OF THE INVENTION

The present invention relates to a static mixer comprising mixing elements for separating the components to be mixed into a plurality of streams, as well as means for the layered junction of the same, including a transversal edge and guide walls that extend at an angle to said transversal edge, as well as deflecting elements arranged at an angle to the longitudinal axis and provided with openings.

PRIOR ART

A static mixer of this kind is e.g. known from U.S. Pat. No. 5,851,067. This patent in turn is a further development of U.S. Pat. No. 5,944,419. These references disclose a mixer that is divided into chambered strings; according to the first cited U.S. patent, four chambered strings are created by four alternately disposed passages and the mixer further comprises re-layering chambers. In the second cited mixer, two flanges or alternatively two pairs of flanges crossing one another are disclosed with passages disposed in such a manner that respective bottom section plates are situated above respective openings.

Although mixers of this kind achieve a better mixing of the components with reference to its length and exhibit a smaller pressure drop than conventional mixers using mixing helixes, they include relatively large dead volumes in which the composition will harden, thereby leading to an eventual plugging of the mixer.

SUMMARY OF THE INVENTION

On the background of this prior art, it is the object of the present invention to provide a static mixer achieving a high mixing efficiency with reduced dead volumes and reduced pressure drop. This object is attained by a static mixer wherein said mixing element comprises a transversal edge and a following transversal guide wall and at least two guide walls ending into a separating edge each with lateral end sections and with at least—one bottom section disposed between said guide walls, thereby defining at least one opening on one side of said transversal edge—and at least two openings on the other side of said transversal edge.

BRIEF DESCRIPTION OF THE DRAWINGS

The invention will be explained in more detail hereinafter with reference to drawings of exemplary embodiments.

DETAILED DESCRIPTION OF THE PREFERRED EMBODIMENTS

Figure 1:
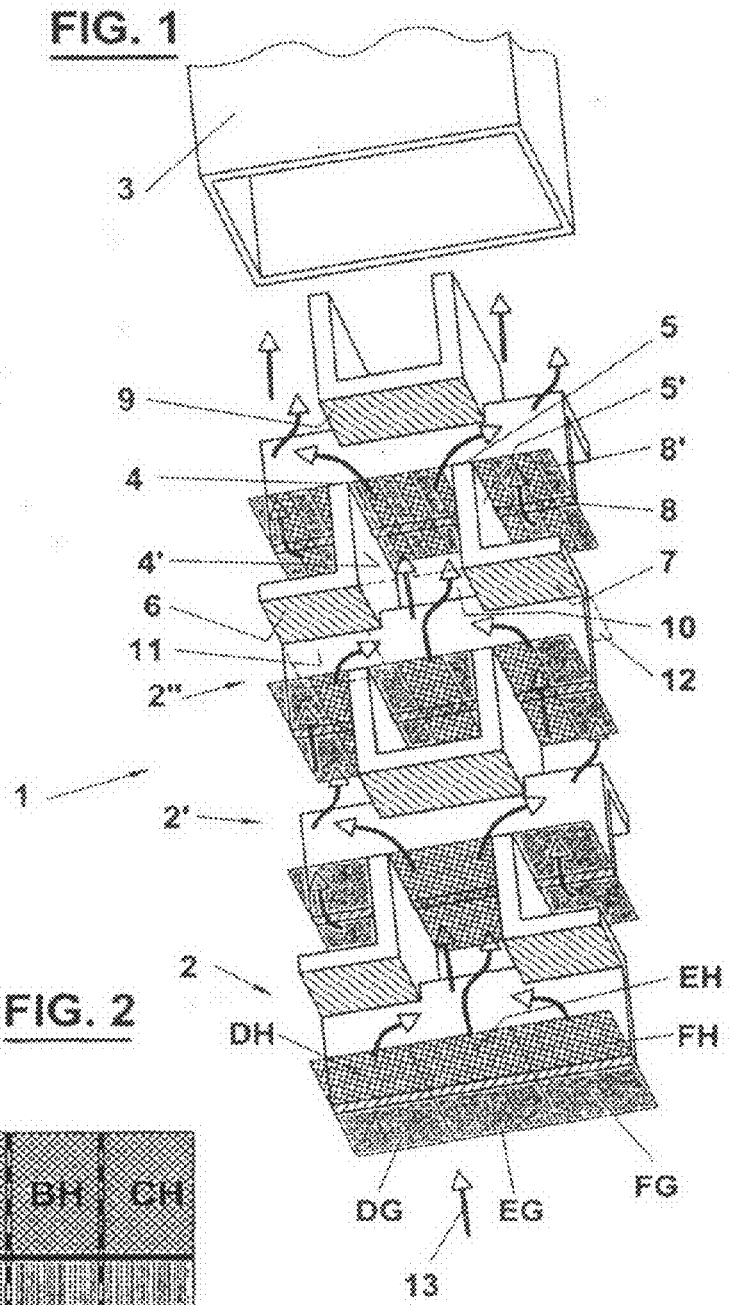
FIG. 1 schematically shows a first exemplary embodiment of a mixer of the invention in a perspective view, FIG. 2 schematically shows the starting position prior to mixing.

FIG. 1 illustrates a detail of a first exemplary embodiment of a mixer 1 of the invention that comprises a number of identical mixing elements 2, 2', and 2", which are superimposed on one another while each successive element is rotated by 180° with respect to the longitudinal axis. Mixing enclosure 3 is schematically shown at one end.

Seen in the flow direction, i.e. from the bottom of the drawing, one end of each individual mixing element 2 comprises a transversal edge 8 of a transversal guide wall 8' that is followed by two end sections 6 and 7 extending perpendicularly thereto and including complementary lateral openings 11 and 12, and by a bottom section 9 and a complementary bottom section opening 10, the latter extending between two guide walls 4', 5' each of which ends in a respective separating edge 4, 5, where the guide walls are aligned in parallel with the longitudinal center axis. In the present example, the end sections extend over half the length of the separating edges. The openings, resp. their cross-sectional areas, and the length of the webs essentially determine the pressure drop between the inlet and the outlet of the mixer.

The mixing element 2' following mixing element 2 comprises the same components and structures, but it is superimposed on first mixing element 2 in a position rotated by 180° with respect to the longitudinal axis. The following mixing elements are also identical to mixing element 2 and arranged one after another while rotated by 180° each as seen in the longitudinal direction. The flow direction is indicated by arrow 13.

Figure 2:
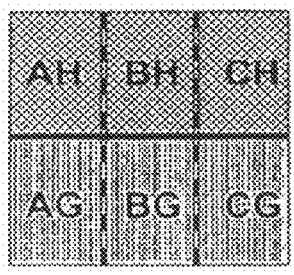
Figure 13:
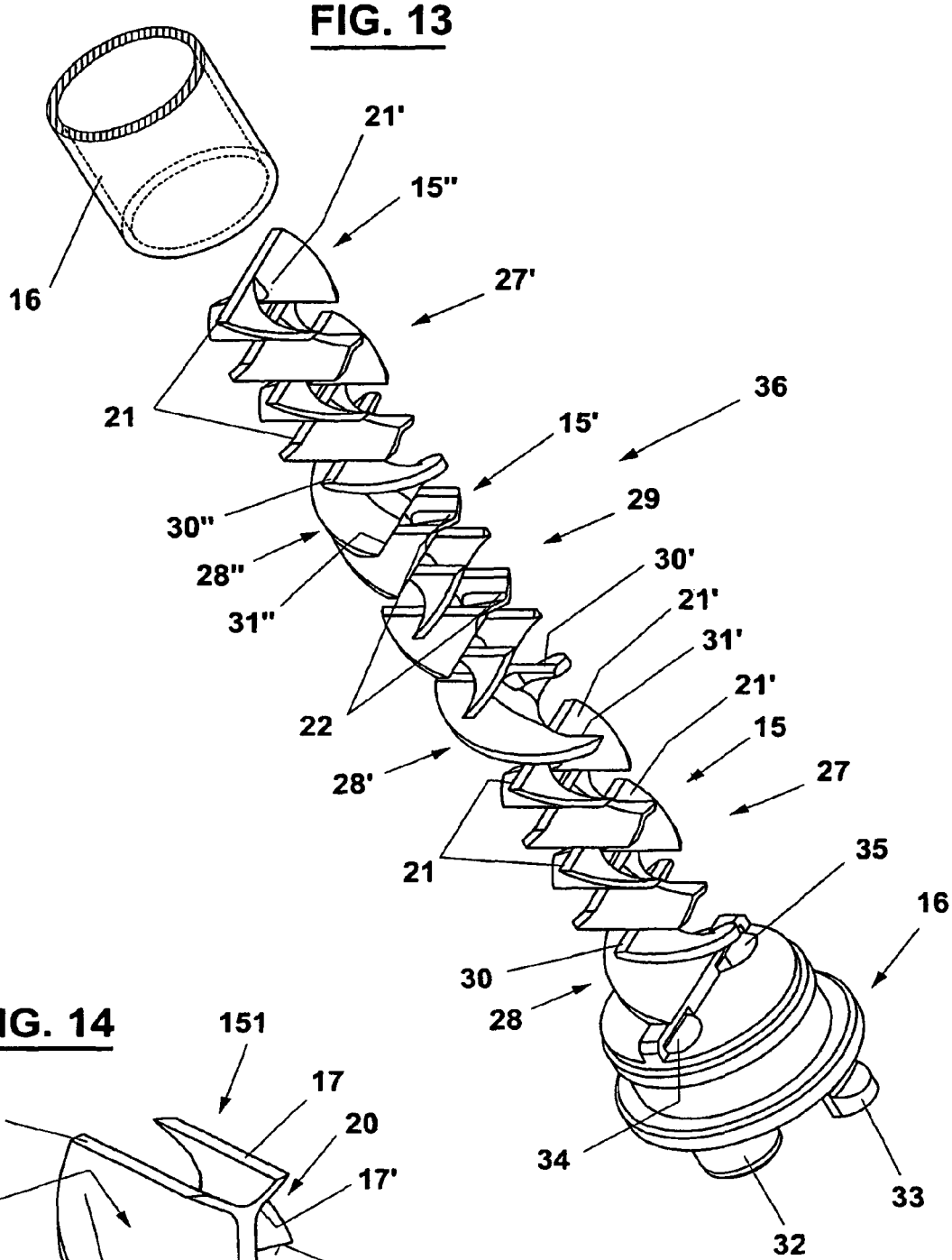
FIG. 13 shows a combination of mixing elements according to the invention and of a mixing helix known per se in the prior art.

FIG. 2 indicates the distribution of the two components G and H at the mixer entrance, each component being supplied from a container of a double cartridge or a dispensing appliance having separate outlets, see FIG. 13. In the present example, according to the flow direction, the mixer entrance is shown at the bottom. After their entrance on either side of transversal edge 8, the components G and H spread along transversal guide wall 8' and are divided into three streams by guide walls 4', 5', so that six streams AG, BG, CG, and AH, BH, and CH are finally produced, to which respective chambers DG, EG, FG; DH, EH, FH may be associated in the mixer.

Figure 3:
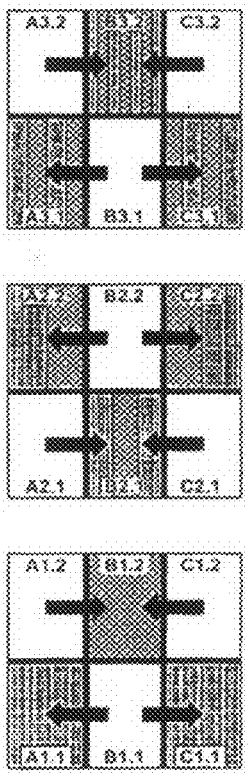
FIG. 3 shows a corresponding mixing diagram.

During further dispensing, the six streams reach the following mixing element 2'. In the process, on one side of the transversal edge, the mixed and spread streams AG, BG, and CG are displaced through lateral openings 11 and 12, and on the other side of the lateral edge, the spread streams AG, BH, GH are displaced through bottom opening 10, as indicated in FIG. 3 schematically. Thus, at the end of element 2, the mixed streams A1.G and C1.G with B1.G as well as A1.H and C1.H with B1.H=A1.1 and C1.1 with B1.1 and A1.2 and C1.2 with B1.2 are obtained according to the diagram of. FIG. 3. After having reached the second mixing element 2', the mixed streams spread on either side of the lateral edge.

Then, the mixed and spread streams A2.1, B2.1, and C2.1 are displaced outwards through lateral openings 11 and 12, and the mixed streams A2.2, B2.2, and C2.2 are displaced inwards through bottom opening 10, as follows from FIG. 3, whereupon these streams are spreading again.

In the next step, the displacement occurs in the other direction, i.e. streams A3.1, B3.1 and C3.1 are displaced inwards and A3.2, B3.2 and C3.2 outwards, as shown in FIG. 3 as well. Again, when entering the following element, the components spread on both sides of the lateral edge and are subsequently displaced again to reach the following mixing element.

The arrangement and the construction of the mixing elements result in a three phase sequence of the mixing process, in which the composition is first divided, then spread and subsequently displaced, only to be divided, spread, and displaced again it the following step.

Figure 4:
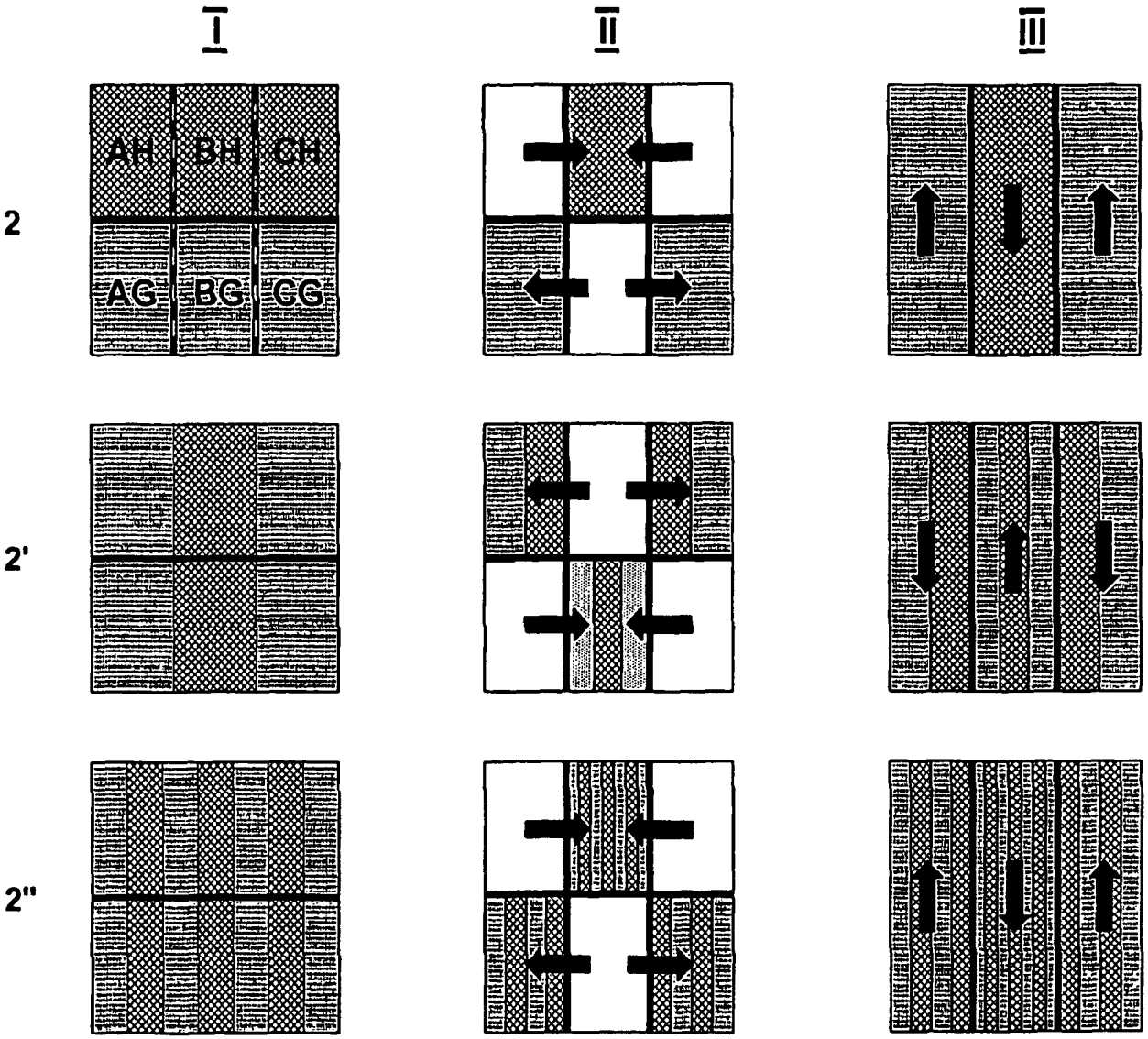
FIG. 4 shows a flow diagram of the mixing operation.

This is shown in the diagram of. FIG. 4, in which the three steps of dividing, displacement and spreading are illustrated in three stages. In the diagram of FIG. 4, separating is symbolized by I, displacement by II, and spreading by III, while the three mixing elements resp. mixing stages are designated by 2, 2', 2". This diagram clearly shows that in mixing element 2, the two components G and H are first divided into two and subsequently into three respective streams, i.e. into six streams AG, BG, CG and AH, BH, GH, then on the one side three mixed streams are displaced through the two lateral openings as two streams and on the other side the three other mixed streams are displaced through bottom opening 10 to form a single stream, and then again to be spread as three mixed streams.

In an alternative embodiment for a larger mixer, more than two separating edges and guide walls may be provided, e.g. three separating edges and guide walls, which in the case of two components divide the material into more then six streams, while the bottom walls resp. openings are arranged in alternate directions resp. mutually offset. Also, as in the preceding example, a transversal edge is provided, so that the streams are divided into two portions. The result is an analogous configuration of a mixing element comprising more than one transversal edge and more than two separating walls.

Alternatively, it is also possible to operate the mixer in the reversed direction with respect to the flow direction, so that the material first reaches the separating edges rather than the transversal edge. Thus, the composition is first divided into three parts and then, during its passage through the two openings, into two parts. In this inverse flow direction, the two outer streams unite and spread on one half of the transversal edge while the two middle streams unite and spread on the other half of the transversal edge.

In FIGS. 5 to 8, mixer 1 is reversed by 180° with respect to FIG. 1 while the flow direction remains the same. For a better understanding, the individual components of the mixing element are listed again. At one end, seen from below in the direction of flow the individual mixing element 2 comprises two separating edges 4 and 5 pertaining to respective guide walls 4', 5', which are aligned in parallel to the longitudinal center axis and comprise, perpendicularly thereto and on either side of the guide walls, two end sections 6 and 7 and a bottom section 9 situated between the guide walls and extending over half of the guide walls. Perpendicularly to the end sections, at the center of the guide walls, a transversal guide wall 8' is arranged which comprises a transversal edge 8 at the other end of the mixing element.

The two end sections and the bottom section are complementarily associated with bottom section opening 10 between the guide walls and with the two lateral openings 11 and 12 on either side of the guide walls. The openings, resp. their cross-sectional areas, essentially determine the pressure drop between the inlet and the outlet of the mixer.

The mixing element 2' following mixing element 2 comprises the same components and structures and is disposed on first mixing element 2 in a position rotated by 180° with respect to the longitudinal axis. Likewise, the following mixing elements are also arranged one after another in positions rotated by 180° each with respect to the longitudinal axis. The flow direction is indicated by arrow 13.

Figure 5:
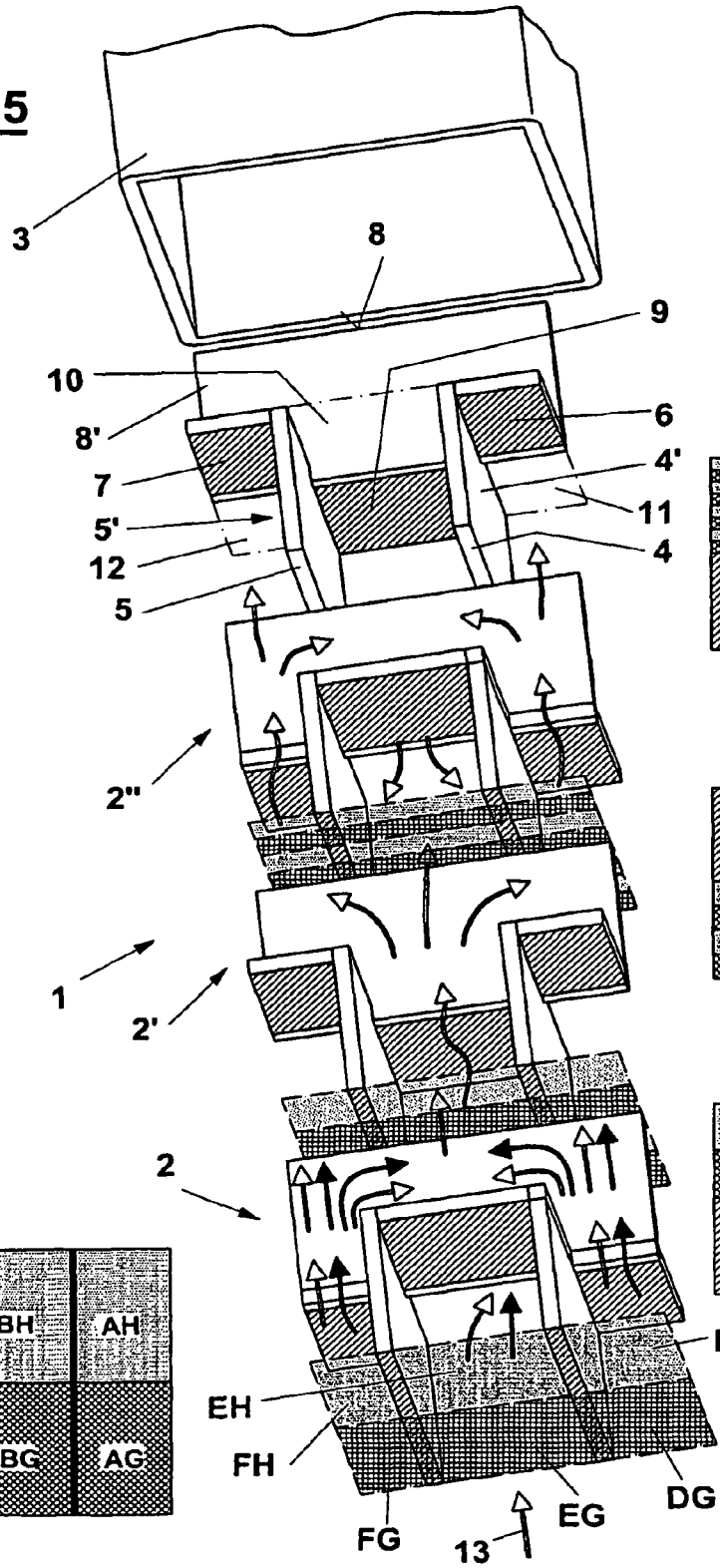
FIG. 5 shows the mixer of FIG. 1 in the inverse flow direction, FIG. 6 schematically shows the starting position of the mixer of FIG. 5 prior to mixing.
Figure 7:
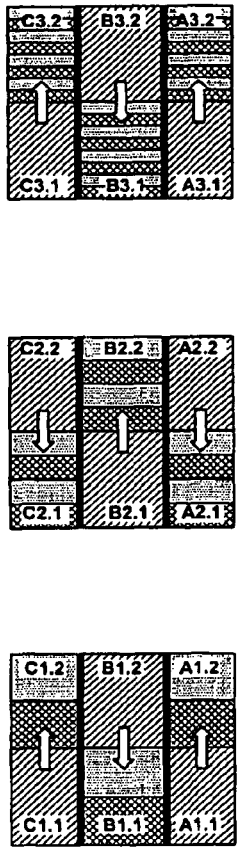
FIG. 7 shows a mixing diagram relating to FIG. 6.
Figure 6:
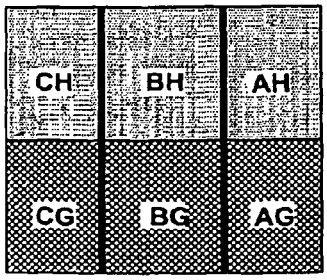

In FIG. 5, the distribution of the two components G and H at the mixer inlet is indicated, each component being supplied from a container of a double cartridge or a dispensing appliance having separate outlets, see FIG. 13. In the present example, according to the flow direction, the mixer inlet is shown at the bottom. When entering the first mixing element 2, the two components are divided by separating edges 4 and 5 into six streams AG, BG, CG and AH, BH, and CH.

During further dispensing, the six streams reach the following mixing element 2'. In the process, the respective pairs of streams A1.G and A1.H, B1.G and B1.H, and C1.G and C1.H=A1.1 and A1.2, B1.1 and B1.2, and C1.1 and C1.2 are mixed with one another according to FIG. 7 while due to the geometrical structure of mixing element 2, stream A1.1 displaces stream A1.2 to reach the following mixing element through lateral opening 11, stream B1.2 displaces stream B1.1 to reach the following mixing element through bottom section opening 10, and stream C1.1 displaces stream C1.2 to reach the following mixing element through lateral opening 12. When they arrive at the second mixing element 2', the mixed streams B2.1 and B2.2 spread on one side of transversal edge 8 on the entire half A2.1-B2.1-C2.1, and likewise, the two mixed streams A2.1, A2.2 and C2.1, C2.2 spread on the other side of transversal edge 8 on the half A2.2, B2.2, and C2.2 shown at the front of the Figure.

In the next step, a displacement in the other direction results, i.e. stream B2.1 displaces stream B2.2, stream A2.2 displaces stream A2.1, and stream C2.2 displaces C2.1, as appears in FIG. 3 as well. Again, when entering the following mixing element, the components spread on a respective half and are subsequently displaced again to reach the following mixing element.

Here also, the arrangement and construction of the mixing elements result in a three phased sequence of the mixing process in which the composition is first divided, then displaced and finally spread, only to be divided, displaced, and spread again in the following step.

Figure 8:
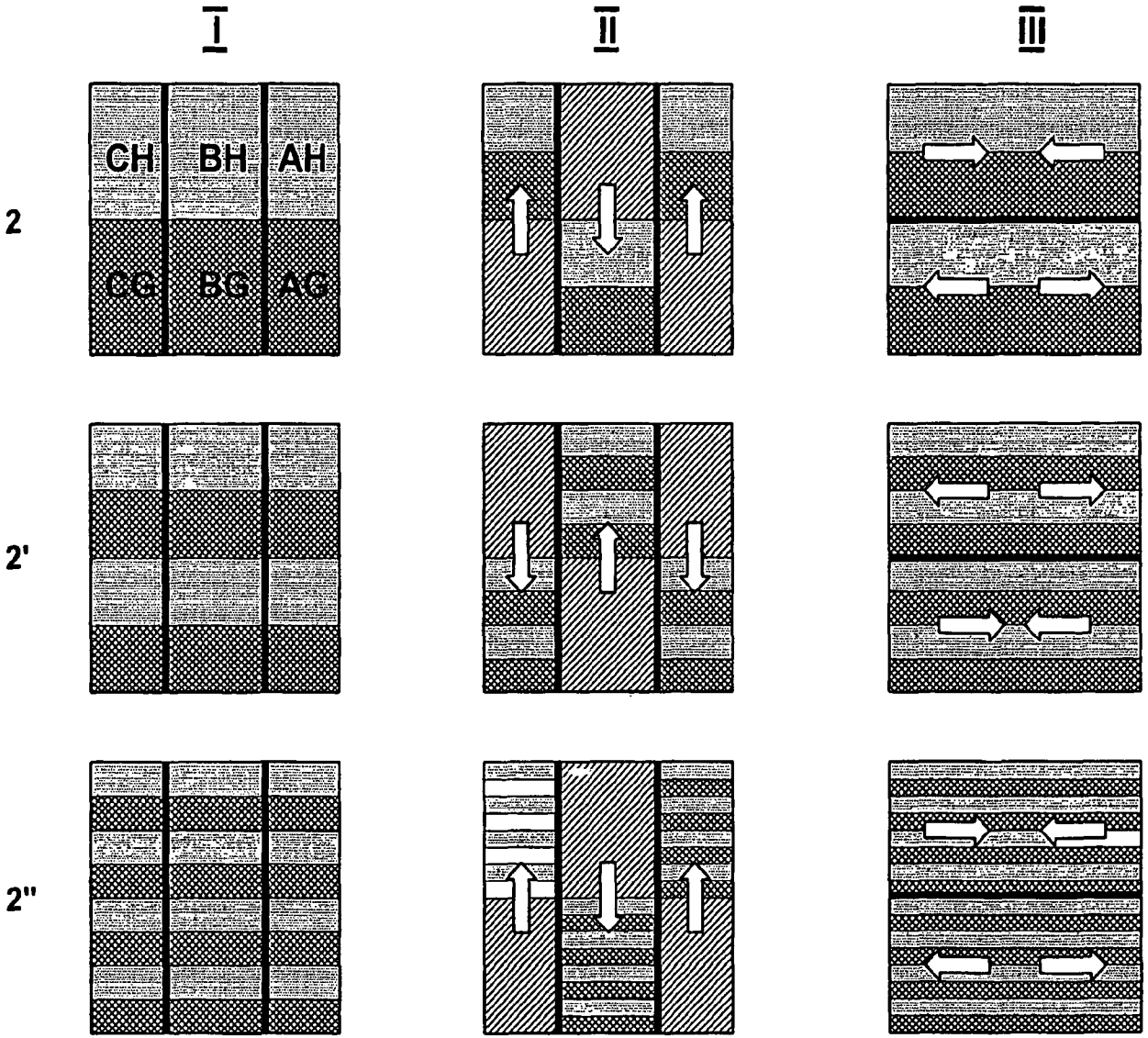
FIG. 8 shows a flow diagram of the mixer of FIG. 5 in the mixing operation, FIG. 9 schematically shows a second exemplary embodiment of a mixer of the invention in a perspective view.

This follows from the diagram of FIG. 8, in which the three steps of dividing, displacing, and spreading are illustrated in three stages. In the diagram of FIG. 8, separating is symbolized by I, displacing by II, and spreading by III, while the three mixing elements as well as the corresponding mixing stages are designated by 2, 2', 2". This diagram clearly shows that in mixing element 2, the two components are divided into six streams, then a respective stream displaces the other one to spread towards the second mixing element 2' in such a manner that the central streams form one half on one side of transversal edge 8 and transversal guide wall 8' while the two outer pairs of streams jointly form the other half on the other side of the transversal edge and the transversal guide wall.

The mixers described above not only provide an intimate mixing of the materials but first of all a lower pressure drop as well as reduced dead volumes as compared to other mixers mentioned in the introduction.

Based on this simplified discussion of the schematic mixing operations, the following variations are possible: In these exemplary embodiments, mixers having rectangular resp. square cross sections have been described, and the two impinging components have the same cross-sectional area. However, this need not always be the case, but any cross-sectional, resp. volume stream ratio of the two components G and H may be chosen at the inlet section, e.g. between 1:1 and 1:10, whereby the dimensions of the mixing elements remain the same. It is however possible to envisage specially adapted mixing elements. This means that the transversal edge need not be arranged on the center line of the mixing element. The same applies to the distance between the separating edges and the guide walls.

Furthermore, the separating edges and guide walls may be arranged at a mutual angle, and likewise, the end sections and the bottom section as well as the transversal edge may be arranged at a mutual angle, so that the openings are not necessarily rectangular or square. Also, the edges, e.g. the transversal edge, may incorporate a bend. The mixing elements need not be arranged one after another in positions rotated by 180°, but any angle from 0° to 360° is possible.

It is also possible to arrange the previously described mixing elements in an enclosure having a cross-section other than rectangular, e.g. in a round, an orbicular, resp. cylindrical, a conical, or an elliptic enclosure.

Whereas the previously described mixing elements provide good mixing properties, the walls arranged at an angle still include dead volumes giving rise to cured material in spite of the improved design. A further reduction of the dead volume is provided by a mixer having mixing elements with curved walls. A mixer of this kind is represented in FIGS. 9 to 12.

Figure 9:
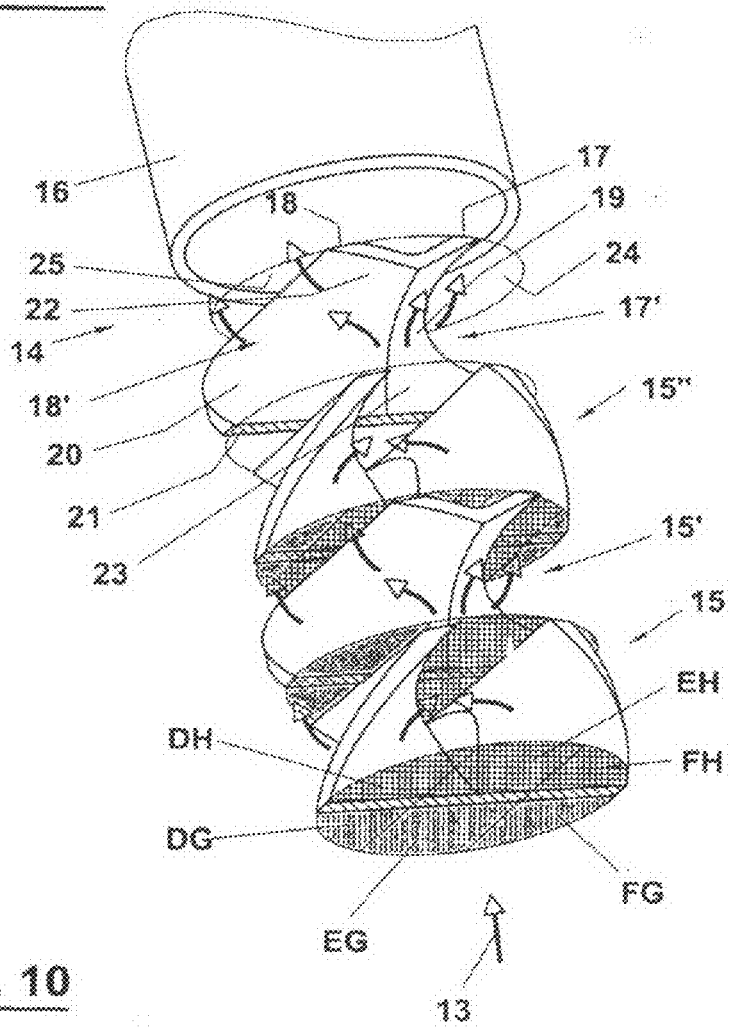

FIG. 9 shows a mixer 14 with a regular cylindric housing as a particular case of a round mixer having mixing elements with curved walls, including mixing elements 15, 15', and 15" and enclosure 16. In analogy to the first mixer 1, at one of its ends, i.e. at the bottom as seen in the flow direction, mixing element 15 comprises a transversal edge 21 where two guide walls 17', 18' originate which end in respective separating edges 17, 18. The guide walls each comprise a respective end section 19 and 20 with lateral openings 24, 25, a bottom section 22, and a complementary bottom section opening 23.

The individual sections are not as clearly demarcated here as in the first exemplary embodiment. In contrast to the rectangular mixing element 2, the two guide walls 17', 18' form a curved and continuous transition between separating edges 17 and 18 situated at one end thereof and transversal edge 21 at the other end. This curved configuration of the guide walls, resp. their transition to the transversal edge appears in FIG. 9, the schematized transition being shown in FIG. 12.

The operation of this second exemplary embodiment is the same as in the first example. In analogy to the latter, the material stream consisting of the two components G and H is divided into a total of six streams AG, BG, CG, AH, BH, and CH as it leaves the first mixing element 15.

Figure 11:
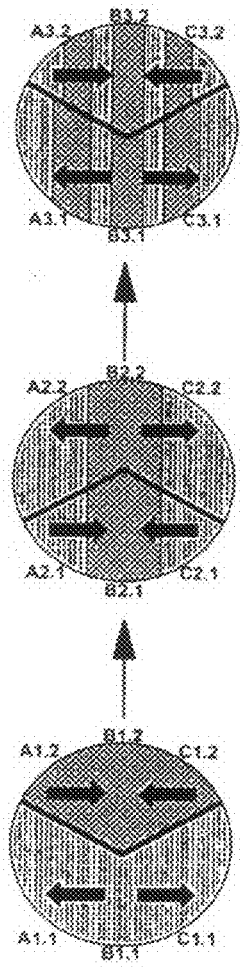
FIG. 11 shows a diagram of the mixing operation in the mixer of FIG. 9.
Figure 10:
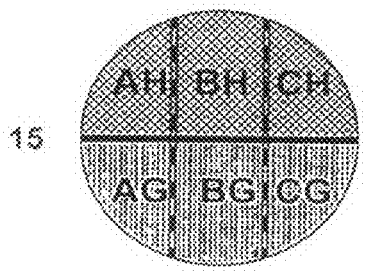
FIG. 10 shows the starting position prior to mixing.

In this example, the mixing operation is effected analogy to the first exemplary embodiment, whereas the guide walls are no longer arranged in a sharp, rectangular disposition but run towards each other in a V-shaped configuration and have a curved shape. The mixing principle according to FIG. 11 is the same as in the first example, i.e. the central stream BG=B1.1 in FIG. 11 mixes with the two other streams AG=A1.1 in FIG. 11 and CG=C1.1 in FIG. 11 and is displaced through lateral openings 24, 25, and spreads while on the other side of the transversal edge, the two outer streams AH=A1.2 and CH=C1.2 mix with central stream BH=B1.2 are displaced through bottom section opening 23, and spread. Due to the curved construction and the V-shaped arrangement of the guide walls, dead volumes are substantially reduced, thereby resulting in reduced losses. On the other hand, this arrangement results in a further reduced pressure drop.

Figure 14:
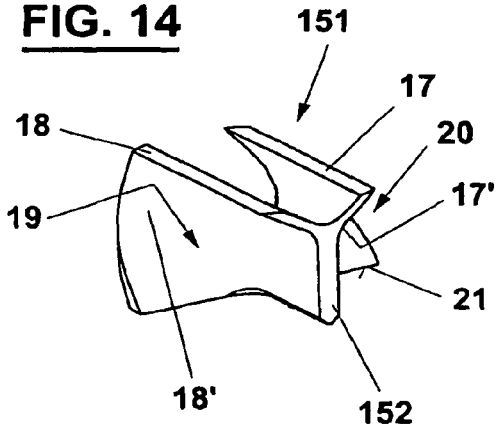
FIG. 14 shows a detail of an alternative embodiment of FIG. 9, FIG. 15 schematically shows another exemplary embodiment of a mixer of the invention.

It is conceivable in this exemplary embodiment that the two guide walls 17', 18' are provided at the transition to transversal wall 21 with an additional web 152 disposed in the longitudinal axis and transversally to the transversal wall, which would theoretically divide the material into three rather than two parts at the exit near the transversal wall, see FIG. 14 illustrating a mixing element 151. However, such an additional web offers no advantages but rather the inconvenience that the material may not spread on that side. It is also possible to provide such a web in the first, rectangular mixer, i.e. below floor 9 and along transversal edge 8. However, the following considerations and the claims do not take account of this additional partition.

Figure 12:
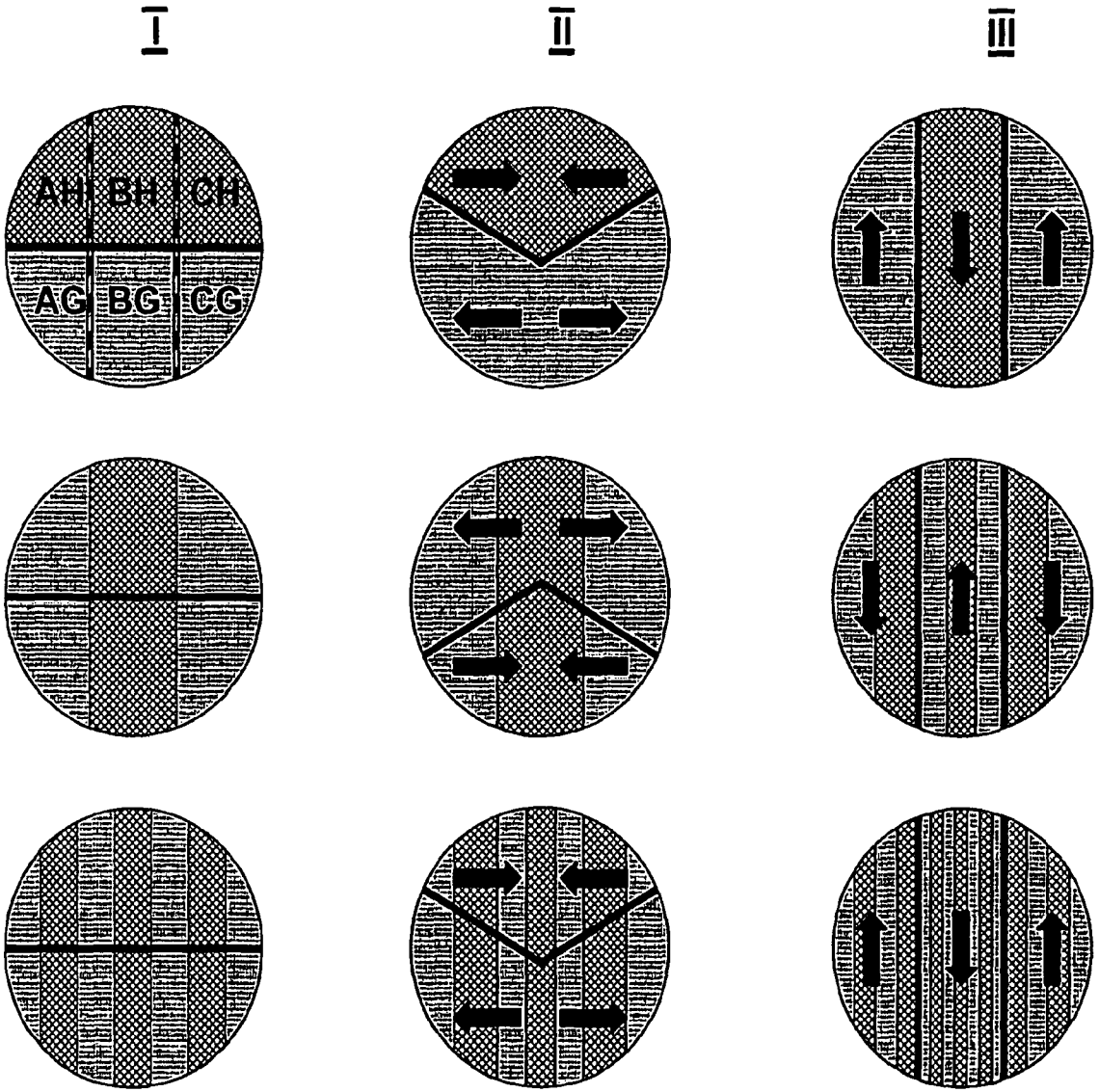
FIG. 12 shows a flow diagram of the mixing operation in the mixer of FIG. 9.

Also, the diagram of FIG. 12 will be interpreted in analogy to the diagram of FIG. 4 with the difference that the perpendicular guide walls 4', 5' provided according to FIG. 4 are V-shaped here and end in the transversal edge.

In analogy to the first example, the cross-sectional, resp. volume stream ratios of the components G and H may be different from 1:1, and most importantly, the guide walls leading from the separating edges to the transversal edge may assume a multitude of geometrical shapes while the mixing elements may be reversed to the shown arrangement with regard to the flow direction. Also, the mixing principle is the same in each case, i.e. the central streams mix with each other and spread on one side of the transversal edge, and then the two outer pairs of streams spread on the respective other side of the transversal edge. Furthermore, the successive mixing elements need not necessarily be rotated by 180° each with respect to the longitudinal axis as shown in FIG. 9 but may be disposed in any orientation.

In the exemplary embodiment of FIG. 13, a novel mixer arrangement is shown which achieves particularly good results with the described mixing elements. FIG. 13 shows a mixer 36, mixer enclosure 16 and the mixer entrance with inlets 32 and 33 and outlet openings 34 and 35. As in the mixers of the prior art using mixing helixes, entrance edge 31 of the first helix mixing element 28 extends transversally across the two outlet openings 34, 35. The two separating edges of first mixing element 15 of first mixing group 27 are disposed transversally to outlet edge 30 of the first helix mixing element. The first mixing group 27 consists of the mixing elements 15, of which four are illustrated here by way of example. This group is followed by the second helix mixing element 28', which in turn is followed by a second mixing group 27'. This second mixing group also consists of four mixing elements 15', which however are reversed by 180° in the direction of flow against the first mixing group, i.e. with the transversal wall directed towards the inlet, whereby this group has a similar effect as that of FIG. 9.

Furthermore, it follows from FIG. 13 that transversal edge 21 of the last mixing element of each mixing group is perpendicular to entrance edge 31' of mixing helix element 28'. The periodical insertion of a mixing helix element serves the purpose of efficiently peeling the material from the walls and of re-layering it, thereby providing a, further improvement of the mixing efficiency.

In FIG. 13, three mixing groups and three mixing helix elements are shown, but it is understood that the number of mixing groups and mixing elements may vary according to the intended purpose. Thus, both the number of mixing elements per mixing group and the number of mixing helix elements between the mixing groups may vary. All considerations concerning the mixing operation and the application of conventional mixing helixes also apply for the homogenization of materials and for mixing arrangements using mixing elements according to FIG. 15.

Figure 15:
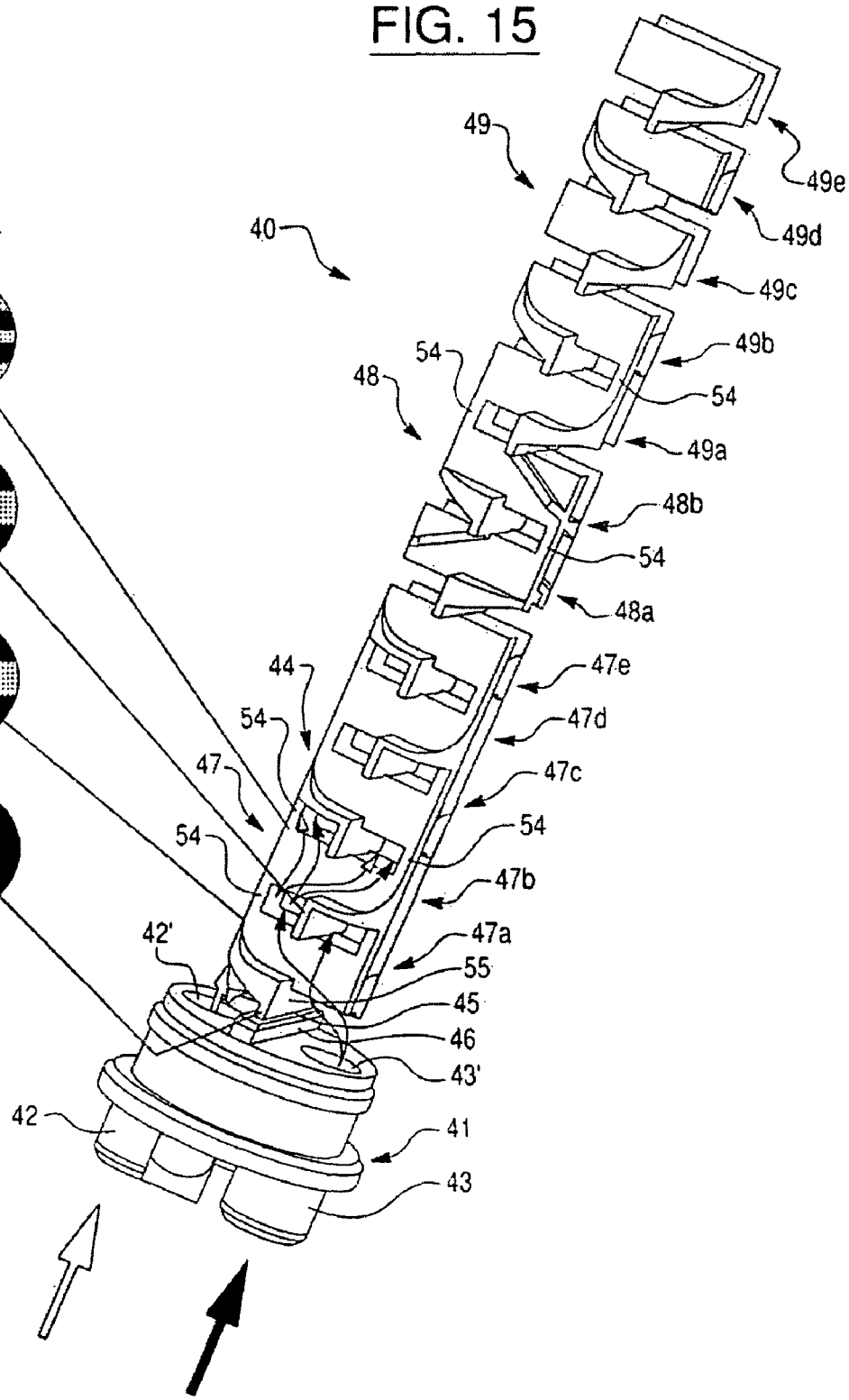
Figure 16:
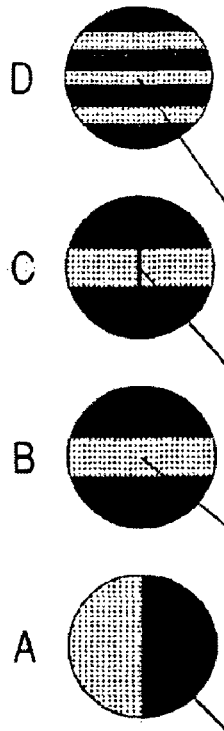
FIG. 16 shows a flow diagram of the mixing operation in the mixer of FIG. 15.
Figure 17:
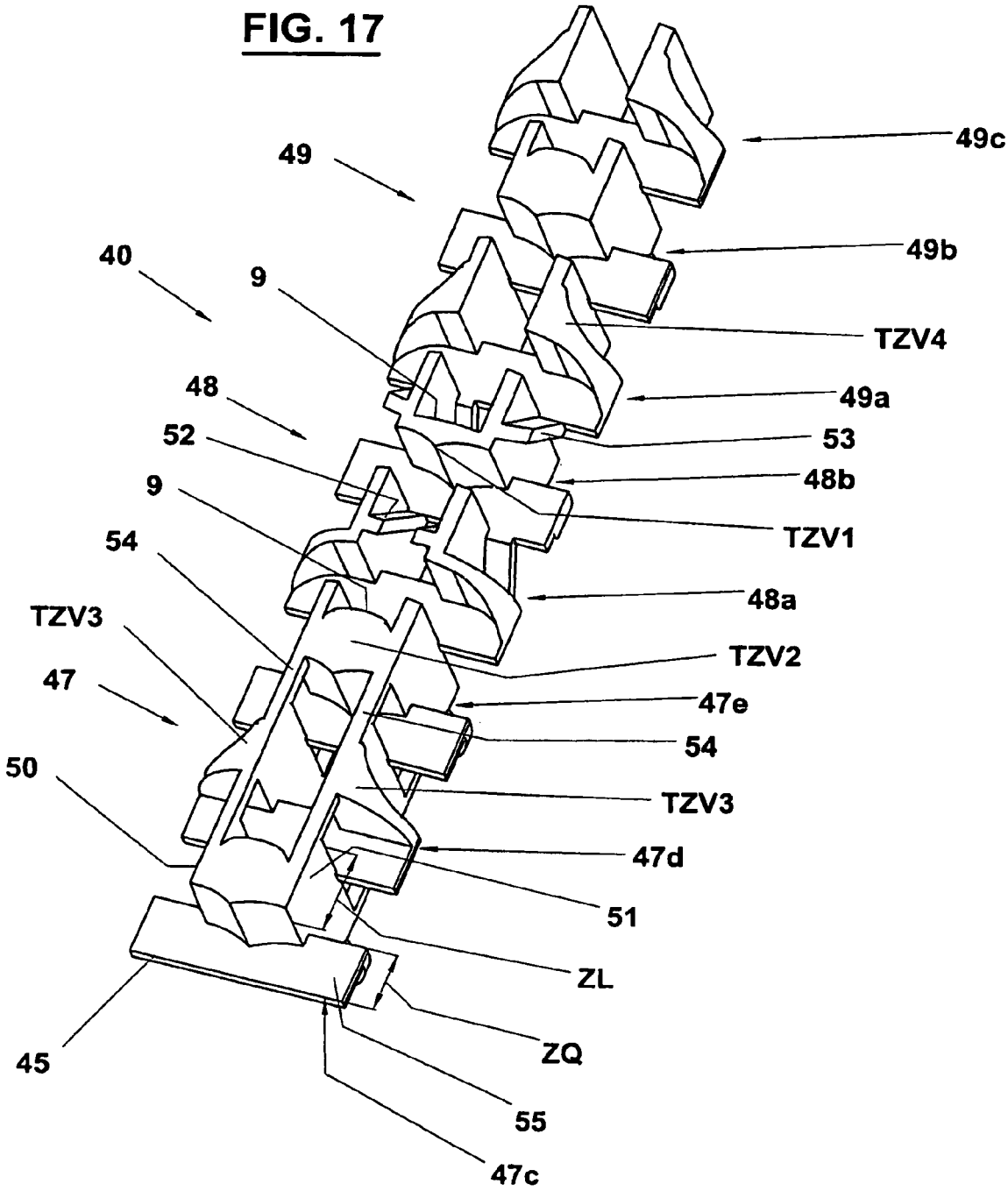
FIG. 17 shows an enlarged detail of the mixer of FIG. 15.

The exemplary embodiment of FIGS. 15-17 is based upon the exemplary embodiment of FIG. 1 with straight element walls, the mixing elements however being arranged in a regular cylindrical housing. In this exemplary embodiment, several features are indicated which provide both an improvement of the mixing action and a reduction of the dead volumes resp. of the losses associated therewith, and thus allow a substantially increased overall efficiency. It is understood that not all of these features need be provided in all mixing elements or mixing groups at the same time.

FIG. 15 shows a mixing element arrangement 40, whereby the housing is not shown, including inlet portion 41 with inlets 42, 43 and outlets 42', 43' as well as mixing section 44 with the mixing elements. Up to the first transversal edge 45, the components are separated by a separating wall 46. In this exemplary embodiment, five mixing elements 47*a*-47*e* are integrated in a first mixing group 47, while the second mixing group 48 comprises two mixing elements 48*a* and 48*b* and the following mixing group 49 again includes five mixing elements 49*a*-49*e*.

Using the mixer according to FIG. 1, 15 or 17 it may be advantageous to provide that the height ZL of guide walls 50, 51, which are reached by the material after the transversal guide wall, is greater than the height ZQ of the transversal guide walls, e.g. by a preferred factor comprised between 1.1 and 2.0, more particularly 1.5. This lengthening of the double guide walls provides an improved alignment of the material, which is thereby allowed more time to spread before being divided again. Furthermore, the lengthening of the double guide walls results in a reduction of the number of mixing elements required to achieve an equal or better mixing quality.

In analogy, when using the mixer according to FIG. 5 in the reversed flow direction it may be advantageous to provide for a greater height ZQ of the transversal guide wall, reached after the guide walls by the material, than the height ZL of the guide walls, also with a preferred ratio of 1.1 to 2.0, in particular 1.5.

A second feature common to all mixing elements are measures for reducing the dead zones, which are particularly important in the case of straight walls and cause volume losses and local curing of the material. To this end, such dead zones are filled in. Different dead zone obturations TZV are indicated especially in FIG. 17. Thus, bottom section 9 comprises dead zone obturations TZV1 of a first type that are directed towards the preceding mixing element. The mixing elements having no inclined webs, i.e. mixing elements 47*a*-47*e* and 49*a*-49*e*, also comprise dead zone obturations TZV2 on the inwardly facing sides of the bottom sections. On the outside of guide walls 50 and 51*a* third and fourth type of dead zone obturations TZV3 and TZV4 are provided in those locations where no inclined webs are present.

At straight walls, wall layers are formed that cause layer defects during layer formation. For the detachment of such layers, for the promotion of the longitudinal mixing action in the direction of the double guide walls, and for equalizing the concentrations, inclined webs are provided on the inside and on the outside of the guide walls.

In the mixer of FIGS. 15 and 17, these inclined webs are attached to the central mixing group 48 where internal inclined webs 52 and external inclined webs 53 are visible, both of which are attached to guide walls 50 and 51 of mixing elements 48*a* and 48*b*.

Wall layers appear not only on the guide walls but also on the inner wall of the mixer enclosure. To optimize the layer formation, longitudinal webs are provided which connect the double guide walls on the outside. The longitudinal webs need not be provided in all mixing groups. In the exemplary embodiment of FIGS. 15 and 17, the longitudinal webs 54 are attached to the first and second mixing groups 47, 48, but they might as well be attached to the third or to any other mixing group, or alternatively in the same way as in mixing group 48.

The suggested measures resp. features are preferably used jointly, but embodiments where only some of the measures are applied are conceivable too.

The flow diagram of the mixing operation is shown in FIG. 16.

At A, the two components spread on the respective side of transversal guide wall 55. At B, the portion on the right side moves towards the center and spreads over the entire length of guide walls 50, 51 while the portion on the left side divides into two halves and forms the outer two thirds. At C, these three streams are divided transversally. At D, the left half is guided towards the center and spreads over the entire length of the guide walls while the portion on the right side is divided and the halves reach respective sides of the guide walls, whereupon a transversal edge follows again, etc.

The following claims are applicable in the simplified case where the transversal edges and guide walls do not comprise any webs as web 152, which do not change the general mixing principle of the mixing elements. Moreover, the definition of a transversal wall includes a possible duplication of the transversal edge into two parallel transversal walls as this does not change the mixing principle either.

What is claimed is:

1. A static mixer, comprising a plurality of mixing elements for separating a material to be mixed into a plurality of streams, wherein each mixing element comprises:

first and second guide walls with a common transversal edge, a separating edge at an end opposite the common transversal edge, wherein the guide walls form a curved and continuous transition between the separating edges and the common transverse edge, wherein the transversal edge divides the material to be mixed, and wherein the first and second guide walls and common transversal edge of a mixing element divide the material into six flow paths.

2. The static mixer of claim 1, wherein a cross-section of the mixer is circular.

3. The static mixer of claim 1, wherein the successive mixing elements are each rotated by 180 degrees about a longitudinal axis of the mixer.

4. The static mixer of claim 1, wherein first and second lateral openings are defined between the first guide wall and an enclosure, and the second guide wall and the enclosure, respectively.

5. The static mixer of claim 1, wherein the transversal edge is perpendicular to a flow direction of material to be mixed.

6. The static mixer of claim 1, further comprising at least one mixing helix, each mixing helix including an entrance edge and an outlet edge.

7. The static mixer of claim 6, wherein the separating edges of the first and second guide walls of a first mixing element are disposed transversally to the outlet edge of a first mixing helix.

8. A static mixer, comprising a plurality of mixing elements for separating a material to be mixed into a plurality of streams, wherein each mixing element comprises:

first and second guide walls with a common transversal edge, a separating edge at an end opposite the common transversal edge, wherein the guide walls form a curved and continuous transition between the separating edges and the common transverse edge, wherein the transversal edge divides the material to be mixed, and wherein the separating edges of the first and second guide walls are connected.

9. The static mixer of claim 8, wherein the separating edges of the first and second guide walls form a V shape.

10. The static mixer of claim 9, wherein the V shape is divided by a bend which runs substantially in a longitudinal direction of the flow path.

11. A static mixer, comprising a plurality of mixing elements for separating a material to be mixed into a plurality of streams, wherein each mixing element comprises:

first and second guide walls with a common transversal edge, a separating edge at an end opposite the common transversal edge; and at least one mixing helix, each mixing helix including an entrance edge and an outlet edge, wherein the guide walls form a curved and continuous transition between the separating edges and the common transverse edge, wherein the transversal edge divides the material to be mixed, and wherein the entrance edge of a first mixing helix extends transversally across an outlet opening of the mixer.

12. The static mixer of claim 11, wherein the mixer comprises a plurality of mixing groups, and a first mixing group includes a plurality of mixing elements, and wherein a second mixing helix follows the first mixing group.

13. The static mixer of claim 12, wherein a second mixing group includes a plurality of mixing elements reversed 180 degrees in a direction of flow from the first mixing group.

14. The static mixer of claim 13, wherein a second mixing helix is positioned between the first mixing group and the second mixing group.

15. The static mixer of claim 13, wherein a transversal edge of the last mixing element of each group is perpendicular to the entrance edge of an adjacent mixing helix.

* * * * *